US009543720B2

(12) United States Patent
Chen

(10) Patent No.: US 9,543,720 B2
(45) Date of Patent: Jan. 10, 2017

(54) POWER DISTRIBUTOR MOUNTING DEVICE

(71) Applicant: Liang Light Chen, Los Gatos, CA (US)

(72) Inventor: Liang Light Chen, Los Gatos, CA (US)

( * ) Notice: Subject to any disclaimer, the term of this patent is extended or adjusted under 35 U.S.C. 154(b) by 37 days.

(21) Appl. No.: 14/645,293

(22) Filed: Mar. 11, 2015

(65) Prior Publication Data

US 2016/0268747 A1 Sep. 15, 2016

(51) Int. Cl.
*H01R 13/66* (2006.01)
*H01R 25/00* (2006.01)

(52) U.S. Cl.
CPC ..... *H01R 25/006* (2013.01)

(58) Field of Classification Search
CPC ..... H01R 31/06; H01R 13/60; H01R 13/73
USPC ..... 439/532, 535, 652, 94, 716, 529
See application file for complete search history.

(56) References Cited

U.S. PATENT DOCUMENTS 5,203,712 A * 4/1993 Kilpatrick ..... H02G 3/288 439/211
6,937,461 B1 * 8/2005 Donahue, IV ..... H01R 13/514 174/50
7,488,203 B2 * 2/2009 Leddusire ..... H01R 13/60 439/535
7,762,039 B2 * 7/2010 Hickey ..... F21V 21/02 248/323
8,241,301 B2 * 8/2012 Zhang ..... A61B 90/11 600/407
8,558,110 B1 * 10/2013 Shotey ..... H02G 3/086 174/50
8,881,468 B2 * 11/2014 McMullen ..... E06B 1/62 248/224.8
2004/0121648 A1 * 6/2004 Voros ..... H01R 13/6215 439/535
2006/0117682 A1 * 6/2006 Chang ..... H01R 13/5213 52/220.1
2008/0220646 A1 * 9/2008 Leddusire ..... H01R 13/60 439/535
2009/0047826 A1 * 2/2009 Velco ..... H01R 13/652 439/501
2011/0240813 A1 * 10/2011 McMullen ..... E06B 1/62 248/224.8
2011/0317974 A1 * 12/2011 Krampotich ..... G02B 6/4452 385/135
2013/0333940 A1 * 12/2013 Stencil ..... H02G 3/18 174/503

* cited by examiner

*Primary Examiner* — Abdullah Riyami
*Assistant Examiner* — Nader Alhawamdeh
(74) *Attorney, Agent, or Firm* — Douglas L. Weller

(57) ABSTRACT

A mounting device for a power distributor includes a base plate having an open longitudinal chute. A sliding block is set in the longitudinal chute and is configured to be able to slide along the longitudinal chute. A connector is attached to the sliding block. The connector is configured to attach to a cabinet that is configured to house the power distributor.

16 Claims, 4 Drawing Sheets

POWER DISTRIBUTOR MOUNTING DEVICE

BACKGROUND

Independent power supply equipment of multiple outlets or device power distributors are widely used in the real world. A power distributor is a block of electrical sockets that is also variously referred to as a power strip, an extension block, a power board, a power bar, a plug board, a trailer lead and by other names. Mounting holes on a power distributor are usually in fixed locations. When a power distributor is installed on a wall or in a cabinet, the existing mounting holes on the wall or cabinet may not match the mounting holes on the power distributor. If the installation location and the height of mounting holes are not ideal, it may be necessary to disassemble the power distributor and adjust the locations of the mounting hole. However such disassembly and adjustment can be difficult.

Figure 1:
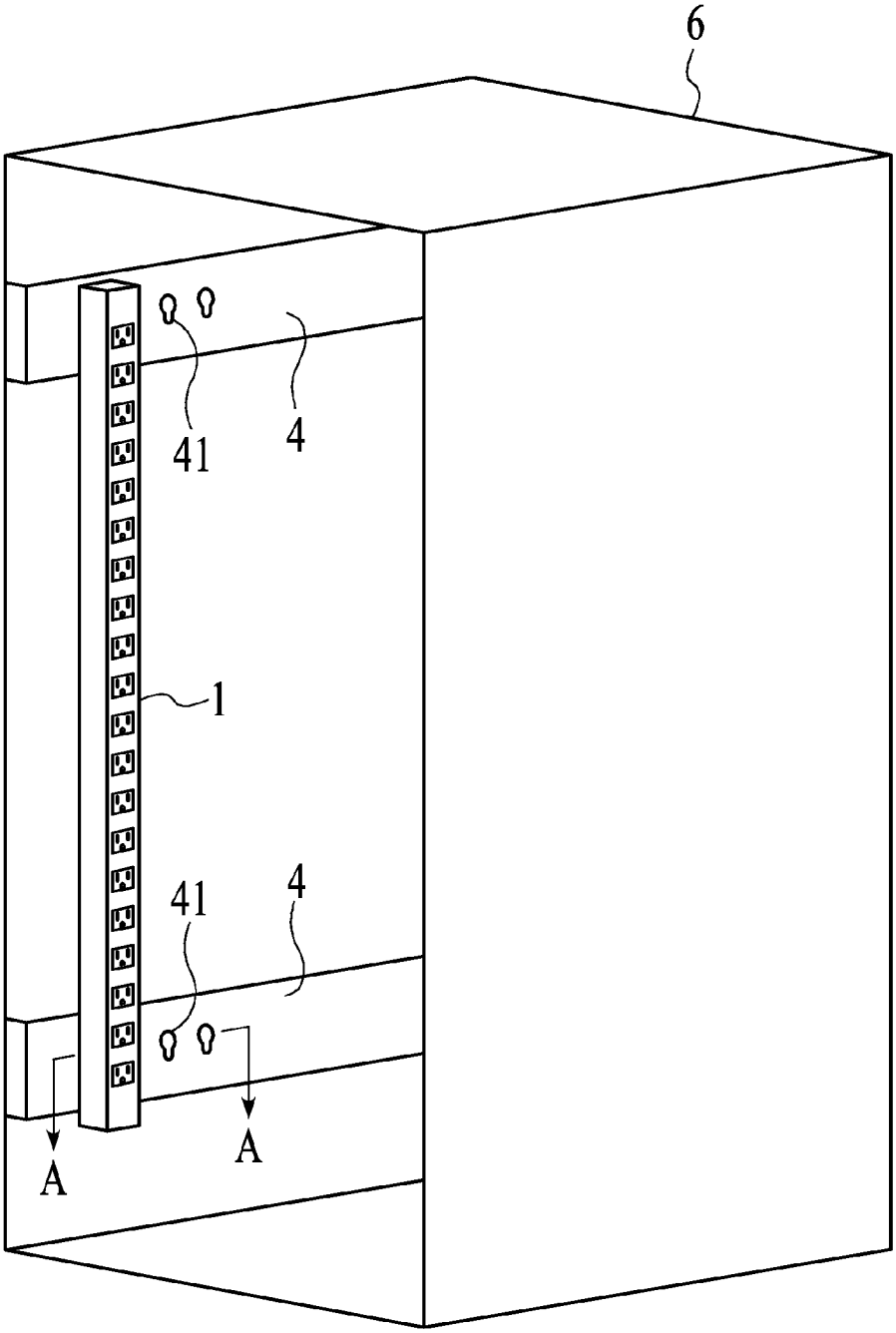
FIG. 1 shows a power distributor mounted in a cabinet in accordance with an implementation.

In the drawings, the main components are labeled as follow:

1—power distributor;

11—base plate;

12—longitudinal chute;

13—marked scale;

2—sliding block;

3—sliding sleeve;

4—holder;

41—slotted holes for hanging;

5—locking bolt;

6—cabinet;

7—support frame;

71—longitudinal and long groove.

DESCRIPTION OF THE EMBODIMENT

The implementations disclosed herein describe an adjustable power distributor mounting device. The structure of the mounting device allows adjustment to fit the installation location.

To achieve the above purpose, the adjustable power distributor mounting device is incorporated into a power distributor. The base plate of the power distributor has an open longitudinal chute. A sliding block is set in the longitudinal chute and slides along the longitudinal chute. A connector attached to the sliding block is provided to connect and align the power distributor mount to a mounting location such as a sidewall of a cabinet.

For example, the mounting device is implemented with the connector being a sliding sleeve whose cross-section is I-shaped. A locking bolt is used to secure the sliding sleeve to the sliding block and when tightened locks the sliding sleeve and the sliding block in a longitudinal location in the longitudinal chute.

Further, the sidewall of cabinet may be provided with a holder. For example, a number of slotted holes for hanging are set on the holder along its length. A lower part of the slotted holes is narrower than the upper part of the slotted holes. A top slot part of the slotted sleeve is placed through the upper part of the slotted hole and slid down to the lower part for secure hanging. The upper part of the slotted hole is wide enough to allow the top slot part of the slotted sleeve to be placed through the slotted hole while the lower part of the slotted hole is sufficiently narrow to secure the top slot part of a sliding sleeve against removal through the slotted hole.

Alternatively, the connector is a support frame. Through the upper portion of the support frame there are a number of locking bolts used to attach the support frame to the sliding block. When tightened the locking bolts lock the support frame and the sliding block in a selected location in the longitudinal chute. The lower portion (or upper portion) of the support frame is provided with a longitudinal and long groove that is connected to the sidewall of the cabinet.

Further, located at the side of the longitudinal chute is a marked scale on the base plate.

For example, the longitudinal chute is a dovetail slot or a T-slot.

Compared with the prior art, the utility model has various advantages. For example, the structure of the mounting device is simple, convenient and practical. Using the marked scale with reference marking lines allows alignment to a desired installation height before installing the power distributor. This mounting device can save installation time and improve efficiency.

To illustrate the above features and advantages, various implementations of the mounting device are described below with reference to the accompanying drawings; however, the mounting device is not limited to these implementations.

FIG. 1, FIG. 2, FIG. 3 and FIG. 4 show a first example of a mounting device.

In FIG. 1 is shown a power distributor 1.

Figure 2:
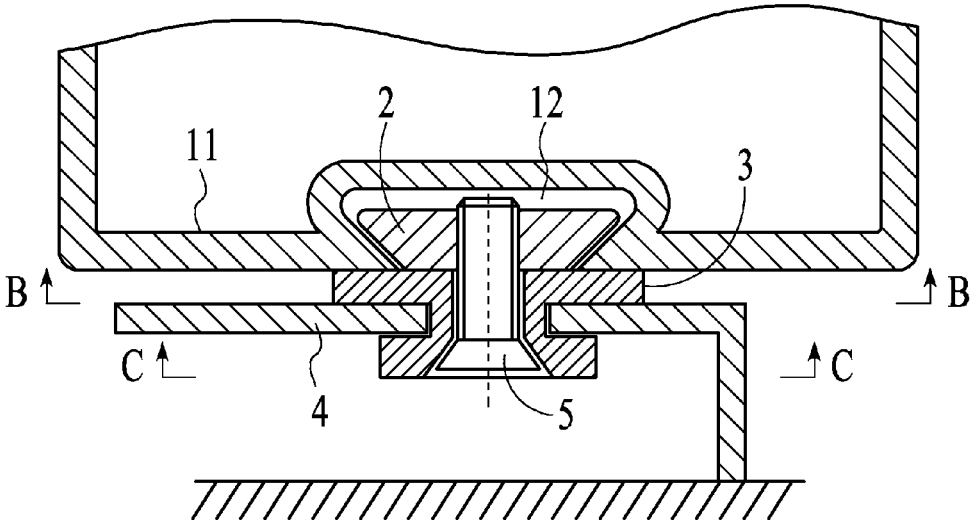
FIG. 2 shows the sectional view of A-A in FIG. 1.
Figure 3:
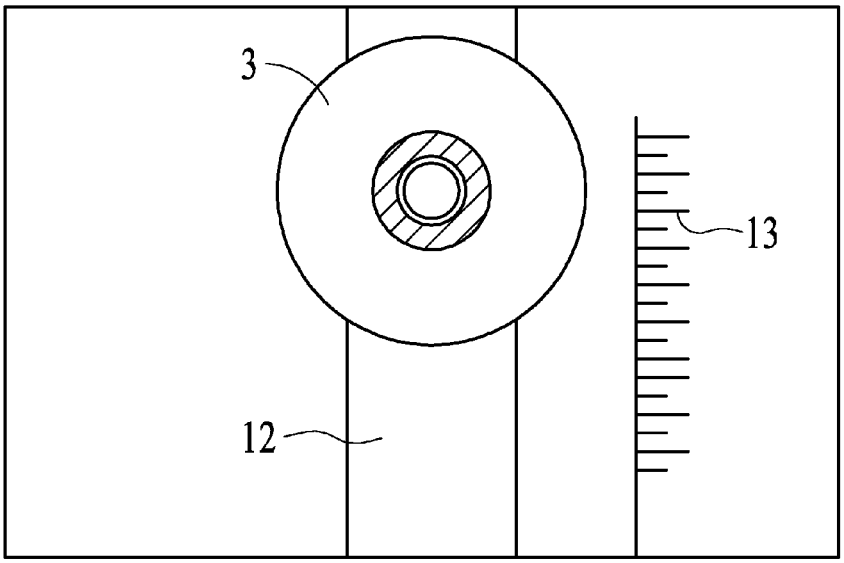
FIG. 3 shows the sectional view of B-B in FIG. 2.
Figure 4:
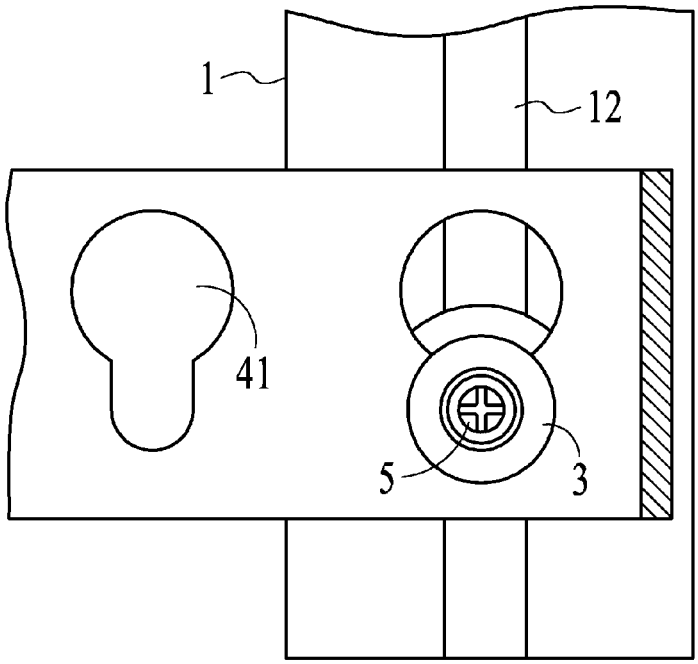
FIG. 4 shows the sectional view of C-C in FIG. 2.

FIG. 2 shows the sectional view of A-A in FIG. 1. FIG. 3 shows a sectional view of B-B in FIG. 2. FIG. 4 shows a sectional view of C-C in FIG. 2.

As shown in FIG. 2, FIG. 3 and FIG. 4, a longitudinal chute 12 is located on a base plate 11 of power distributor 1. For example longitudinal chute 12 is a dovetail slot as shown in FIG. 2. A sliding block 2 is set in the longitudinal chute 12 and slides along the longitudinal chute 12. Once in a desired position, sliding block 2 is secured to power distributor 1 and ready for placement on a sidewall of cabinet 6, as shown in FIG. 1.

For example, a sliding sleeve 3 acts as a connector between cabinet 6 and power distributor 1. Sliding sleeve 3 has an I-shaped cross-section as shown in FIG. 2. A locking bolt 5 is placed through the sliding sleeve 3 and allows sliding block 2 to be secured to the longitudinal chute 12 once sliding sleeve 3 is in a desired longitudinal location.

For example, as shown in FIG. 1, the sidewall of cabinet 6 is provided with holders 4. Each holder 4 has a number of slotted holes 41. The upper portion of slotted hole 41 is wider than the lower portion of slotted hole 41. This allows a top slot part of a sliding sleeve 3 to be placed through the upper portion of slotted hole 41 and to slide down in order to securely fasten sliding sleeve 3 in place in the lower portion of slotted hole 41.

For example, as shown in FIG. 3, a marked scale 13 can be located on base plate 11, at one or both sides of longitudinal chute 12.

To mount power distributor 1 on the sidewall of cabinet 6, sliding block 2 is inserted into longitudinal chute 12. Sliding sleeve 3 and sliding block 2 are connected by locking bolt 5. Using the reference lines of marked scale 13, sliding sleeve 3 is aligned to a desired installation height and locking bolt 5 is tightened so that the sliding sleeve 3 and the sliding block 2 are fixed in a desired location along chute 12 on power distributor 1. This is repeated for an upper and a lower portion of power distributor 1. At both the upper and the lower portion of power distributor 1, the top slot part of a sliding sleeve 3 is placed through a slotted hole 41. The top slot part of a sliding sleeve 3 is then slid down slotted hole 41 to secure power distributor 1 to holders 4 of cabinet 6.

Figure 5:
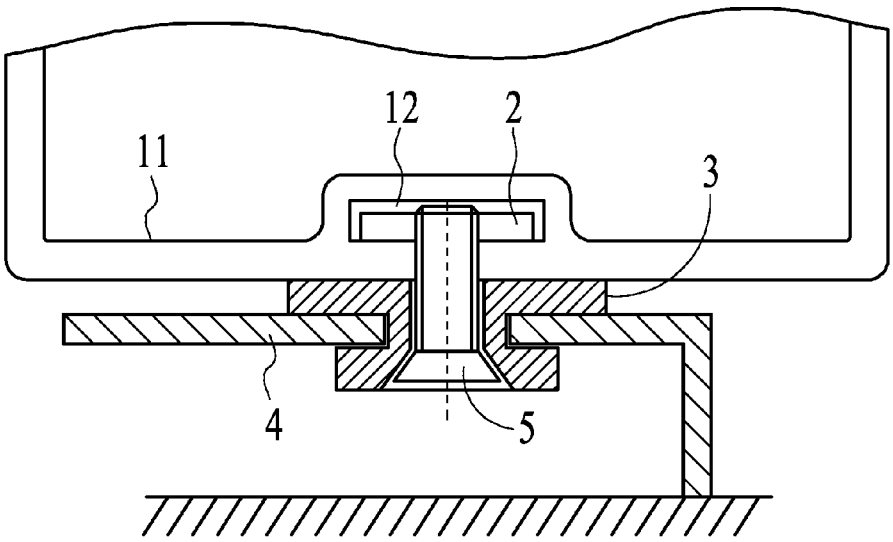
FIG. 5 shows a structure diagram of the longitudinal chute that is a T-slot in accordance with an alternative implementation.

FIG. 5 shows an alternative implementation where, the longitudinal slot 12 is a T-slot. This changes the shape of longitudinal slot 12 and sliding block 2 as can be seen by comparing FIG. 2 with FIG. 5.

Figure 6:
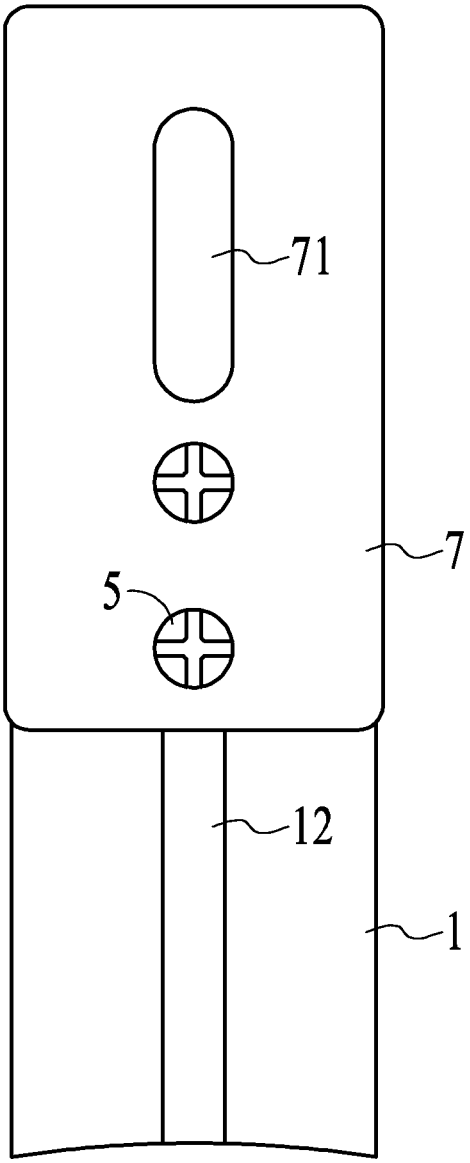
FIG. 6 shows an alternate implementation of power distributor mounting device in accordance with an implementation.

FIG. 6 shows an alternative implementation where sliding sleeve 3 has been replaced with a support frame 7. On base plate 11 of power distributor 1, a longitudinal chute 12 is opened. As discussed above, for example, longitudinal chute 12 is a dovetail slot or T-slot. Sliding block 2 is set in the longitudinal chute 12 and slides along the longitudinal chute 12. Support 7 acts as a connector that is set on sliding block 2 to connect and locate the power distributor 1 and the sidewall of cabinet 6.

As shown in FIG. 6, one or more locking bolts 5 screw into sliding block 2 in order to lock the support frame 7 and the longitudinal chute 12. Support frame 7 is also provided with a longitudinal and long groove 71. The long groove is used to connect power distributor 1 to the sidewall of the cabinet 6.

For example, as shown in FIG. 3, a marked scale 13 can be located on base plate 11, at one or both sides of longitudinal chute 12.

To mount power distributor 1 on the sidewall of cabinet 6, sliding block 2 is inserted into longitudinal chute 12. Support frame 7 is connected to sliding block 2 using locking bolts 5. The reference lines of marked scale 13 can be used to align location of support frame 7 in longitudinal chute 12 according to a desired installation height before tightening locking bolts 5 so that support frame 7 and the sliding block 2 are fixed in a correct position on power distributor 1. Long groove 71 of support frame 7 is then used to attach to power distributor 1 on the sidewall of cabinet 6. For example, a sliding sleeve 3 can be attached to long groove 71 so that a slot part of a sliding sleeve 3 is placed through a slotted hole 41 of holders 4 of cabinet 6. The top slot part of sliding sleeve 3 is then slid down slotted hole 41 to secure power distributor 1 to holders 4 of cabinet 6.

The foregoing discussion discloses and describes merely exemplary methods and embodiments. As will be understood by those familiar with the art, the disclosed subject matter may be embodied in other specific forms without departing from the spirit or characteristics thereof. Accordingly, the present disclosure is intended to be illustrative, but not limiting, of the scope of the invention, which is set forth in the following claims.

What is claimed is:

1. A power distributor comprising:

a plurality of electrical sockets; and, a mounting device, the mounting device including;

a base plate, the base plate having an open longitudinal chute, the base plate being part of the housing for the electrical sockets so that a location of the base plate is fixed with respect to locations of the electrical sockets, a sliding block set in the longitudinal chute that is configured to be able to slide along the longitudinal chute so that sliding the sliding block along the longitudinal chute changes a location of the sliding block with respect to the locations of the electrical sockets while the location of the base plate remains fixed with respect to the locations of the electrical sockets, and a connector attached to the sliding block, the connector being configured to attach to a cabinet that is configured to house the power distributor.

2. The power distributor of claim 1 wherein the cabinet includes a sidewall to which the connector is attached.

3. The power distributor of claim 1:

wherein the connector is a sliding sleeve, the sliding sleeve having an I-shape; and, wherein a locking bolt through which the sliding sleeve is connected the sliding block to the sliding block so that tightening the locking bolt locks the sliding sleeve in the longitudinal chute.

4. The power distributor of claim 1 wherein the cabinet includes a sidewall to which the connector is attached, the sidewall having a holder, the holder including a plurality of slotted holes, each slotted hole in the plurality of slotted holes having an upper portion and a lower portion, the upper portion being wider than the lower portion allowing a top slot part of the sliding sleeve to be placed through the upper portion and to slide down in order to securely fasten sliding sleeve in place in the lower portion.

5. The power distributor of claim 1:

wherein the connector is a support frame, having two portions, a first portion of the support frame having at least one locking bolt through which the support frame is connected to the sliding block so that tightening the locking bolt locks the support frame in the longitudinal chute; and, wherein a second portion of the support frame includes a longitudinal and long groove that is connected to a sidewall of the cabinet.

6. The power distributor of claim 1, wherein the base plate includes a marked scale placed along a portion of the longitudinal chute.

7. The power distributor of claim 1, wherein the longitudinal chute is a dovetail slot.

8. The power distributor of claim 1, wherein the longitudinal chute is a T-slot.

9. A mounting device for a power distributor, comprising:

a base plate, the base plate having an open longitudinal chute, the base plate being part of the housing for electrical sockets so that a location of the base plate is fixed with respect to locations of the electrical sockets;

a sliding block set in the longitudinal chute that is configured to be able to slide along the longitudinal chute so that sliding the sliding block along the longitudinal chute changes a location of the sliding block with respect to the locations of the electrical sockets while the location of the base plate remains fixed with respect to the locations of the electrical sockets; and, a connector attached to the sliding block, the connector being configured to attach to a cabinet that is configured to house the power distributor.

10. The mounting device of claim 9 wherein the cabinet includes a sidewall to which the connector is attached.

11. The mounting device of claim 9:

wherein the connector is a sliding sleeve, the sliding sleeve having an I-shape; and, wherein a locking bolt through which the sliding sleeve is connected the sliding block to the sliding block so that tightening the locking bolt locks the sliding sleeve in the longitudinal chute.

12. The mounting device of claim 9 wherein the cabinet includes a sidewall to which the connector is attached, the sidewall having a holder, the holder including a plurality of slotted holes, each slotted hole in the plurality of slotted holes having an upper portion and a lower portion, the upper portion being wider than the lower portion allowing a top slot part of the sliding sleeve to be placed through the upper portion and to slide down in order to securely fasten sliding sleeve in place in the lower portion.

13. The mounting device of claim 9:

wherein the connector is a support frame, having two portions, a first portion of the support frame having at least one locking bolt through which the support frame is connected to the sliding block so that tightening the locking bolt locks the support frame in the longitudinal chute; and, wherein a second portion of the support frame includes a longitudinal and long groove that is connected to a sidewall of the cabinet.

14. The mounting device of claim 9, wherein the base plate includes a marked scale placed along a portion of the longitudinal chute.

15. The mounting device of claim 9, wherein the longitudinal chute is a dovetail slot.

16. The mounting device of claim 9, wherein the longitudinal chute is a T-slot.

* * * * *